US005893237A

United States Patent [19]

Ryon et al.

[11] Patent Number: 5,893,237

[45] Date of Patent: Apr. 13, 1999

[54] INFLATABLE TENT CONSTRUCTION

[76] Inventors: Michael J. Ryon; Michael E. Ochs, both of 2111 Kasold, Apt. B-301, Lawrence, Kans. 66047

[21] Appl. No.: 09/030,799

[22] Filed: Feb. 26, 1998

[51] Int. Cl.[6] ..... E04B 1/343

[52] U.S. Cl. ..... 52/2.18; 52/81.4; 52/82; 52/DIG. 10; 135/116; 135/147

[58] Field of Search ..... 52/DIG. 10, 81.1, 52/81.4, 2.18, 2.24, 82; 135/116, 126, 128, 137, 143, 144, 147, 151, 153, 156, 157, 158, 159, 160; D25/32, 23, 13

[56] References Cited

U.S. PATENT DOCUMENTS

| | | | |
|---|---|---|---|
| D. 272,168 | 1/1984 | Sielaff | D25/13 |
| 1,546,222 | 7/1925 | Finlay | 135/157 |
| 1,964,818 | 7/1934 | Hood | 135/156 |
| 2,938,526 | 5/1960 | Harrison, III et al. | 52/2.18 |
| 2,979,064 | 4/1961 | Fischer | 52/81.4 |
| 3,059,658 | 10/1962 | Finlayson | 135/147 |
| 3,332,178 | 7/1967 | Foster | 52/82 |
| 3,502,091 | 3/1970 | Corbin | 135/147 |
| 3,640,034 | 2/1972 | Shotwell, Jr. | 52/81.4 |
| 3,660,952 | 5/1972 | Wilson | 52/81.4 |
| 3,742,658 | 7/1973 | Meyer | 52/2 |
| 3,994,102 | 11/1976 | Johnson et al. | 52/2 |
| 4,295,302 | 10/1981 | Liu | 52/2 |
| 4,332,112 | 6/1982 | Hsu | 52/2 |
| 4,393,887 | 7/1983 | Orobin | 135/153 |
| 4,413,452 | 11/1983 | Wilkinson | 52/81.4 |
| 4,632,138 | 12/1986 | Irwin | 135/143 |
| 4,807,405 | 2/1989 | Borgquist | 52/2.18 |
| 4,937,987 | 7/1990 | Runyon | 52/DIG. 10 |
| 4,951,432 | 8/1990 | Wilkinson | 52/DIG. 10 |
| 5,007,212 | 4/1991 | Fritts et al. | 52/2.18 |

FOREIGN PATENT DOCUMENTS

| | | | |
|---|---|---|---|
| 1260165 | 3/1961 | France | 52/2.18 |

*Primary Examiner*—Michael Safavi
*Attorney, Agent, or Firm*—Henderson & Sturm

[57] ABSTRACT

An inflatable tent construction 10 including a wall unit 11, and a roof unit 12 fabricated from fifteen side panels 40 wherein each side panel 40 comprises a panel member 30 surrounded by two inflatable side channels 21, 22, and an inflatable base channel 23 that define generally identically shaped equilateral triangles. The wall unit comprises first and second groups of five panel members 30, respectively, and the roof unit 12 comprises a third group of five panel members 30 to create the pentadecahedron configuration of the wall 11 and roof 12 units of the tent construction.

9 Claims, 2 Drawing Sheets

INFLATABLE TENT CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of tent constructions in general, and in particular to inflatable tent constructions.

2. Description of Related Art

As can be seen by reference to the following U.S. Pat. Nos. 3,742,658; 3,994,102; 4,295,302; and 4,332,112, the prior art is replete with myriad and diverse inflatable wall tent constructions.

While all of the aforementioned prior art constructions are more than adequate for the basic purpose and function for which they have been specifically designed, they do not represent the culmination of efforts to improve upon the overall design of inflatable tents.

In particular, the Meyer patent at first glance shares many structural similarities to the present invention; however, a more detailed comparison of the two constructions will reveal a number of significant differences.

In all inflatable tent constructions, the primary objective is to provide an inflatable chamber tent wall support system that is both practical and effective.

As a consequence of the foregoing situation, there has existed a longstanding need for a new and improved type of inflatable tent construction that has a unique wall support configuration that provides improved stability and support over the prior art constructions, and the provision of such a construction is a stated objective of the present invention.

BRIEF SUMMARY OF THE INVENTION

Briefly stated, the inflatable tent construction that forms the basis of the present invention comprises a wall unit, a roof unit, and a floor unit. The wall and roof units include an inflatable tubular framework which defines an pentadecahedron configuration having fifteen side panels that have the same general equilateral triangular shape.

As will be explained further on in the specification, each of the side panels include a pair of inflatable side channels and an inflatable base channel that define an equilateral triangle that surrounds a panel member.

Furthermore, the wall unit and the roof unit of the tent construction comprise fifteen virtually identically configured side panels arranged into an pentadecahedron configuration. The wall unit comprises a first and a second group of five side panels respectively, arranged in a particular pattern and the roof unit comprises a third group of five side panels arranged in a different pattern.

In addition, the floor unit comprises a generally pentagon shaped floor member having an outer inflatable ring element including a plurality of inflatable cushion segments and an inner inflatable core element including another inflatable cushion segment.

It should also be noted that this invention also includes a template for fabricating the pentadecahedron shaped tent construction. The template includes four rows of side panels wherein each row includes a different number of side panels, and all of the side panels except one side panel is formed contiguously with the other side panels in a particular row of side panels.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
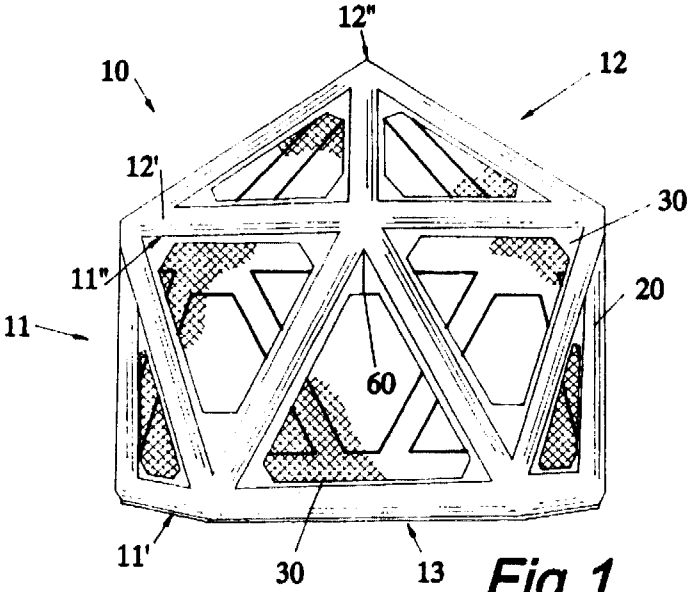
FIG. 1 is a perspective view of the inflatable tent construction that forms the basis of the present invention.

As can be seen by reference to the drawings, and in particularly to FIG. 1, the inflatable tent construction that forms the basis of the present invention is designated generally by the reference number 10. The tent construction comprises in general, a wall unit 11, a roof unit 12, and a floor unit 13. These units will now be described in seriatim fashion.

Figure 2:
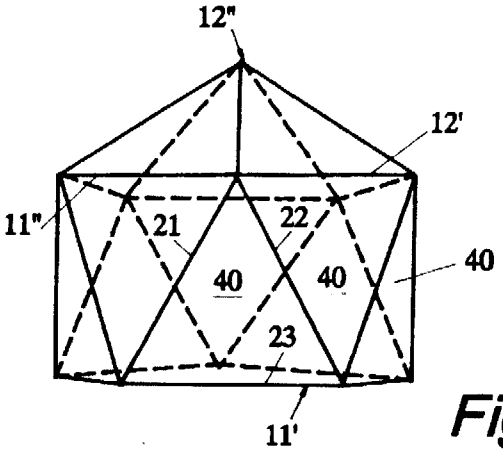
FIG. 2 is an isometric elevation view of the framework arrangement.
Figure 3:
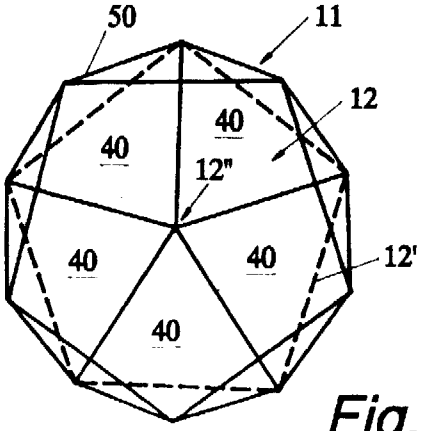
FIG. 3 is an isometric top plan view of the framework arrangement.

As can be seen by reference to FIGS. 1 through 3, both the wall unit 11 and the roof unit 12 comprise a plurality of pneumatically interconnected tubular chambers 20 arranged into a pentadecahedron configuration wherein each side panel 40 of the fifteen sided pentadecahedron shape comprises an equilateral triangle shaped panel member 30 surrounded by the two inflatable side channels 21, 22 and the inflatable base channel 23 of an equilateral triangle shaped tubular chamber 20.

Figure 4:
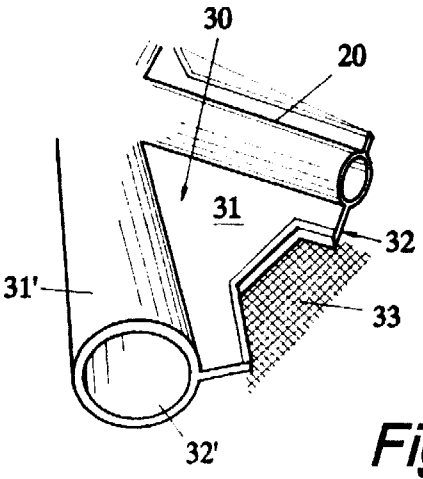
FIG. 4 is an isolated detail view of one of the side panels.
Figure 5:
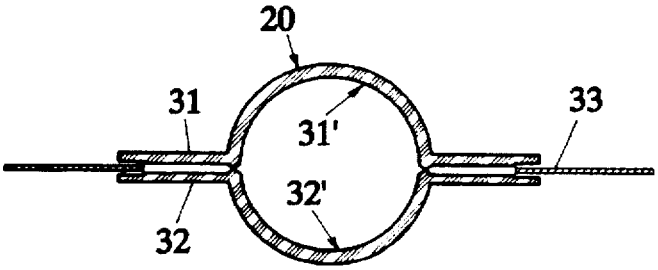
FIG. 5 is a cross section view taken through line 6—6 of FIG. 4.

As can best be seen by reference to FIGS. 4 and 5, the outer periphery of the panel members 30 comprise two sheets 31, 32 of air impervious material having portions which are sealed together to captively engage a triangular shaped netting element 33. In addition, the tubular chambers 20 are fabricated from unsealed portions 31', 32' of the sheets of material 31, 32 in a well recognized fashion.

Figure 7:
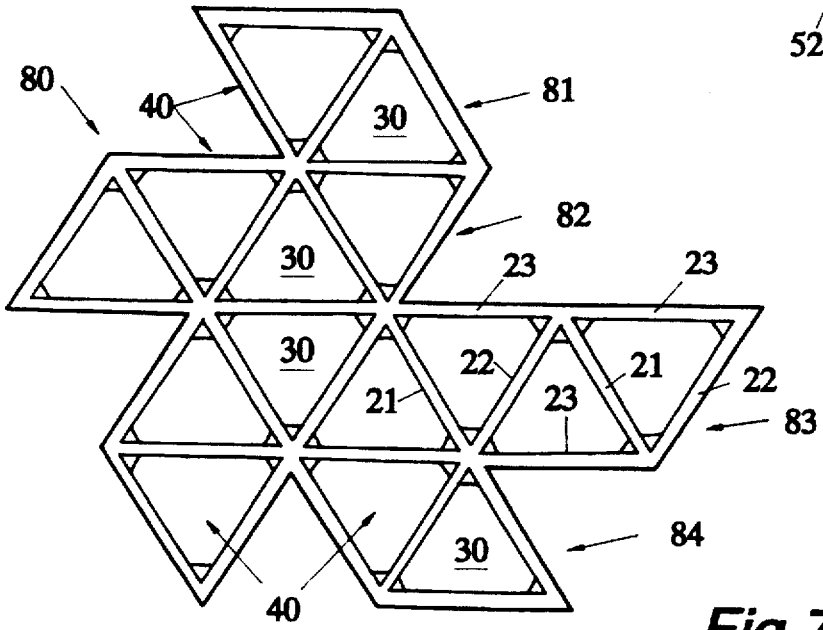
FIG. 7 is a top plan view of the pentadecahedron construction template for the tent wall and roof units.

As shown in FIGS. 2, 3, and 7, each of the side panels 40 of the pentadecahedron shaped tent construction is virtually identical in size, shape, and configuration. The wall unit 11 comprises ten side panels 40 and the roof unit 12 comprises five side panels 40.

As can best be seen by reference to FIGS. 1 and 2, the wall unit 11 comprises a first group of five side panels 40 wherein the base channel 23 of the side panels 40 define the bottom 11' of the wall unit 11 and a second group of five side panels 40 wherein the base channels 23 of the side panels 40 define both the top 11" of the wall unit 11 and the bottom 12' of the roof unit 12.

In addition, the roof unit 12 comprises a third group of five side panels 40 wherein the channels 23 of the side panels 40 define the bottom 12' of the roof unit 12 as previously discussed and wherein the apexes of the side panels 40 define the top or apex 12" of the roof unit 12.

Figure 6:
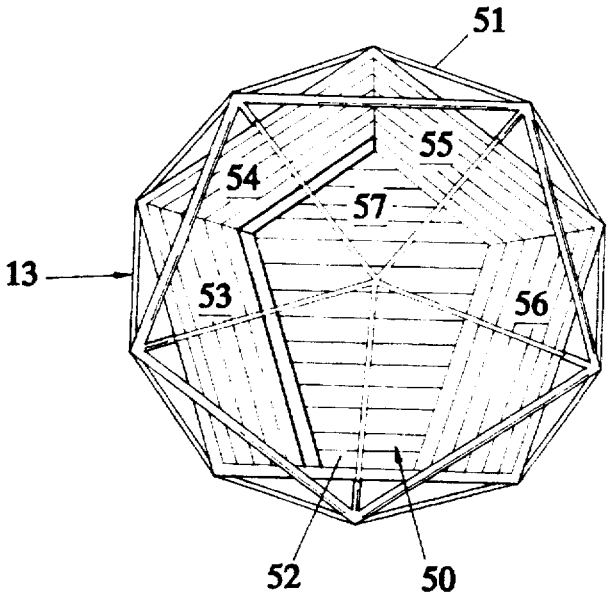
FIG. 6 is a top plan view of the floor assembly as viewed through the roof support channels.

Turning now to FIG. 6, it can be seen that the floor unit 13 comprises a five sided pentagon shaped floor member 50 comprising a generally C-shaped outer inflatable ring element 51 and an inner inflatable core element 52. The outer inflatable ring element 51 comprises four inflatable cushion segments 53, 54, 55, and 56 which may be selectively inflatable to form air mattress style supports. The inner inflatable core element 52 comprises another inflatable cushion segment 57 that is disposed at an angle relative to the other cushion segments 53, 54, 55, 56 which comprise the outer inflatable ring element 51.

In addition, as shown in FIG. 3, the pentagon shaped floor member 50 is outlined in dashed lines wherein the corners of the roof unit 12 are offset by an angle of 36° relative to the corners of the floor member 50.

As can best be seen by reference to FIG. 7, the wall unit 11 and roof unit 12 can be formed from a template 80 which comprises four rows of side panels 40 which constitute the fifteen side panels 40 that comprise the pentadecahedron tent construction 10 that forms the basis of this invention.

As shown in FIG. 7, the top or first row 81 comprises a pair of contiguous side panels 40, the second row 82 comprises four contiguous side panels 40, the third row 83 comprises six contiguous side panels 40 and the bottom or fourth row 84 comprises three side panels 40 wherein two of the side panels 40 members are contiguous, and the remaining side panel 40, are offset from the contiguous pair of panel members.

In addition, as shown in FIG. 1, at least one of the side panels 40 that form the first group of five side panels whose base channels 23 define the bottom 11' of the wall unit is provided with an opening 60 that provides access into the interior of the tent construction.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

We claim:

1. An inflatable tent construction comprising:

a plurality of identically configured side panels wherein each side panel comprises a pair of inflatable tubular side channels and an inflatable base channel which forms a generally equilateral triangle which surrounds a panel member;

a wall unit including a first group of five side panels wherein the base channel of the five side panels defines the bottom of the wall unit and a second group of five side panels, wherein the base channel of the second group of five side panels defines the top of the wall unit; and a roof unit including a third group of five side panels wherein the base channels of the third group of five side panels define the bottom of the roof unit, the base channels of the second group of five side panels and the base channels of the third group of side panels are the same; and wherein the apexes of the individual side panels in the third group of five side panels defines the top of the roof unit.

2. The construction as in claim 1 wherein each panel member comprises two sheets of air impervious material having portions that are sealed together to captively engage a screen insert and other portions which are spaced from one another to define the inflatable side channels and the inflatable base channel.

3. The construction as in claim 2 further comprising;

a floor unit including a floor member having a generally c-shaped outer inflatable ring element and an inner inflatable core element.

4. The construction as in claim 3 wherein the outer inflatable ring element comprises a plurality of inflatable cushion segments arranged in a generally C-shaped configuration.

5. The construction as in claim 4 wherein each of said plurality of inflatable cushion segments are selectively inflatable.

6. The construction as in claim 5 wherein the inner inflatable core element comprises another inflatable cushion segment.

7. The construction as in claim 6 wherein the said another inflatable cushion segment is angularly disposed relative to said plurality of inflatable cushion segments.

8. A template for the fabrication of a pentadecahedron shaped tent construction having fifteen side panels forming the wall unit and top unit of the tent construction comprising:

a plurality of rows of side panels wherein each side panel includes a pair of inflatable side channels and an inflatable base channel surrounding an equilateral triangle shaped panel member;

a first row comprising a pair of contiguous side panels;

a second row comprising four contiguous side panels;

a third row comprising six contiguous side panels; and a fourth row of three side panels wherein at least two of the side panels are contiguous.

9. The template as in claim 8 wherein all of the side panels are virtually identical in size.

* * * * *